US005094596A

United States Patent [19]

Erwin et al.

[11] Patent Number: 5,094,596

[45] Date of Patent: Mar. 10, 1992

[54] HIGH PRESSURE PISTON PUMP FOR FLUENT MATERIALS

[75] Inventors: Larry R. Erwin, North Hollywood; James E. Cavanaugh; Robert D. Hetherington, both of Sunland, all of Calif.

[73] Assignee: Binks Manufacturing Company, Franklin Park, Ill.

[21] Appl. No.: 531,850

[22] Filed: Jun. 1, 1990

[51] Int. Cl.[5] ..... F04B 35/00

[52] U.S. Cl. ..... 417/397; 417/568

[58] Field of Search ..... 417/397, 503, 568

[56] References Cited

U.S. PATENT DOCUMENTS

| | | | |
|---|---|---|---|
| 1,043,267 | 11/1912 | Stallsworth . | |
| 2,531,705 | 11/1950 | Schultz | 60/54.5 |
| 2,569,903 | 10/1951 | Santarelli | 222/263 |
| 2,625,886 | 1/1953 | Browne . | |
| 2,786,656 | 3/1957 | Corneil | 259/151 |
| 3,174,409 | 3/1965 | Hill | 91/306 |
| 3,233,554 | 2/1966 | Huber et al. | 103/157 |
| 3,318,151 | 5/1967 | Smith | 103/49 |
| 3,679,332 | 7/1972 | Yohpe | 417/503 |
| 3,802,805 | 4/1974 | Roeser | 417/398 |
| 3,806,285 | 4/1974 | Sech | 417/568 |
| 4,029,442 | 6/1977 | Schlosser | 417/489 |
| 4,035,109 | 7/1977 | Drath et al. | 417/403 |
| 4,116,364 | 9/1978 | Culbertson et al. | 222/40 |
| 4,178,133 | 7/1979 | Rawicki | 417/63 |
| 4,350,266 | 9/1982 | Hetherington et al. | 222/40 |
| 4,373,874 | 2/1983 | Phillips | 417/397 |
| 4,381,179 | 4/1983 | Pareja | 417/273 |
| 4,516,725 | 4/1985 | Cavanaugh et al. | 239/127 |
| 4,637,295 | 1/1987 | Powers et al. | 92/170 |
| 4,690,308 | 9/1987 | Cavanaugh et al. | 222/156 |
| 4,824,342 | 4/1989 | Buck | 417/503 |

FOREIGN PATENT DOCUMENTS

| | | |
|---|---|---|
| 1826051 | 2/1961 | Fed. Rep. of Germany . |
| 1357961 | 6/1974 | United Kingdom . |

OTHER PUBLICATIONS

Xenex Pump Sketch (prior to Jun. 1, 1989).

Karassik, Krutzsch, Fraser & Messina, "Pump Handbook" (2d Ed. 1986), pp. 9, 235-236.

*Primary Examiner*—Richard A. Bertsch

*Assistant Examiner*—Charles G. Freay

*Attorney, Agent, or Firm*—Juettner Pyle & Lloyd

[57] ABSTRACT

A pump assembly especially adapted for pumping viscous and/or abrasive materials is comprised of a pair of opposed single acting piston pumps operated alternately by an interposed reciprocal actuator, and a static chamber interposed between each pump and the actuator; each pump comprising a pumping chamber having aligned inlet and outlet check valves in its peripheral wall and defining a straight line path of fluid flow diametrically through the chamber, a piston having its periphery spaced from the peripheral wall of the pumping chamber and having a relatively short stroke to maintain the straight line path of fluid flow through the chamber, and an annular seal extending from the peripheral wall of the pumping chamber toward the piston and bridging the gap between the periphery of the piston and the peripheral wall of the pumping chamber, the piston having sealed engagement with the seal throughout its reciprocal path of movement; the static chambers isolating the two pumps and the actuator from one another so that fluid leakage from any of them will not adversely affect the others. The pump assembly facilitates pressurized or forced feeding of fluent material to the two pumps, and therefore, the pumping of extremely viscous fluent materials, and utilization of the assembly in a wide variety of systems applications.

11 Claims, 3 Drawing Sheets

HIGH PRESSURE PISTON PUMP FOR FLUENT MATERIALS

FIELD OF THE INVENTION

The present invention relates to high pressure piston pumps especially adapted for the pumping of viscous and/or abrasive fluent materials, and in particular, a pump assembly that is comprised of a pair of opposed single acting piston pumps operated alternately by means of an interposed reciprocal actuator, such as a fluid actuated, dual acting motor.

BACKGROUND

A pump assembly of the type above-described is disclosed in U.S. Pat. No. 4,029,442 to Schlosser and U.S. Pat. No. 4,035,109 to Drath and Schlosser. Both patents include a disclosure of a single-acting pump having a piston that is smaller than and spaced from the walls of the pump cylinder chambers and that moves into and out of a piston sealing structure during the reciprocal movement of the pump piston in its forward or pumping stroke and its return or suction stroke. The sealing structure helps maintain the piston spaced from the walls of the cylinder chambers and provides the only surface in the pump with which the piston engages so there is no metal to metal contact, and therefore, reduced friction and wear. The two patents disclose respectively different cylinder mounted sealing means for bridging the space or gap between the piston and the walls of the associated cylinder chambers on the pressure or pumping strokes of the piston. In the patented device, the pump piston is withdrawn completely from its seal on its rearward or suction strokes and is forced back through the seal on its forward or pumping strokes. This mode of operation causes a suction force to be generated in the pumping chamber on the suction stroke of the piston, thereby to induce flow of viscous material into an intake chamber rearwardly of the pumping chamber and thence into the pumping chamber as the piston releases from its seal.

With the intake chamber located upstream, i.e., rearwardly, of the pumping chamber, the piston rod of the piston extends through the fluent material in the intake chamber to the piston actuating air motor and has to be very effectively and efficiently sealed to the air motor to prevent entry into the air motor of the fluent material being pumped, and to prevent entry of air into the intake chamber which would render the pump inoperable.

If the piston is of greater diameter than the piston rod, as is usually the case, the back and forth movement of the piston within the intake chamber causes pulsation or surging of the fluent material in the intake chamber, which consumes some of the energy imparted to the piston by the air motor, and imposes a high stress load on the seal between the air motor and the piston rod. To mitigate the problems thus generated, the pump has no inlet valve and/or has surge absorbing or compensating means in the inlet to the pump, so that the fluent material can surge or pulse back and forth within the intake chamber and the inlet to the pump without imposition of undue pressure on the seal. Design considerations thus inhibit or prevent pressurized or force feeding of fluent materials into the pump inlet.

Because of these design considerations and the viscous/abrasive nature of the fluent material, the only commercially practical seal for the piston rod is a bellows seal. Use of a bellows seal further inhibits preloading or force feeding of the fluent material into the intake chamber because any significant degree of pressure would collapse the bellows, rupture the seal, render the pump inoperable, and potentially cause extensive damage to the air motor components.

For these reasons, the prior art pump is essentially dependent upon the suction force generated by the retracting piston as it releases from its seal, and cannot tolerate a force-fed or pressurized source of fluent material at the pump inlet. This limits the number of materials that can be handled by the pump and the number of systems applications in which the pump can be successfully employed.

Despite their many shortcomings, pumps of the type described have enjoyed commercial success, in the form particularly of the "Glutton" pumps sold by Graco, Inc. and the "Funny" pumps sold by Binks Manufacturing Company, the assignee of this application.

Other patents disclosing single acting pumps having operational characteristics the same as or similar to the pump described include Medo, German Gebrauchsmuster (utility model patent) No. 1,826,851; Penn, British Patent No. 1,357,961; Stallsworth, U.S. Pat. No. 1,043,267; Santarelli, U.S. Pat. No. 2,569,903; Corneil, U.S. Pat. No. 2,786,656; and Roeser, U.S. Pat. No. 3,802,805.

Another type of single acting pump is disclosed in U.S. Pat. No. 3,174,409 to Hill. The pump disclosed in the Hill patent differs from the above-described prior art pumps in that it does not have an intake chamber rearwardly of the pumping chamber, utilizes a piston/piston rod of uniform diameter smaller than the diameter of the pumping chamber, which is in continuous engagement with and does not leave its seal, and has a pumping chamber provided with an inlet valve as well as an outlet valve. However, in Hill, the seal between the piston/piston rod and the pumping chamber also separates the pumping chamber from the air motor actuator, with the consequence that any leakage past the seal will result in ingestion of air into the pumping chamber on the piston suction stroke and pumping of fluent material into the air motor on the piston pressure stroke. Also, due to the small diameter and long stroke of the piston, and the small diameters of the fluid receiving chambers, fluent material passing through the chambers will have a flow path in the shape of a "Tee", which is not conducive to pumping viscous or shear sensitive materials. Consequently, even though Hill discloses in-line inlet and outlet valves leading to a common pumping chamber, including a piston spaced from but having a sealed relationship with the walls of the chamber, the pump of the Hill patent suffers too many disadvantages to be suitable for heavy-duty industrial use.

Other patents showing in-line inlet and outlet check valves, in different pump environments, include Browne, U.S. Pat. No. 2,625,886, Smith, U.S. Pat. No. 3,318,251, and Rawicki, U.S. Pat. No. 4,178,133.

An additional prior art disclosure of interest is the Huber U.S. Pat. No. 3,233,544. This patent discloses an air compressor having a pair of interconnected opposed pistons operating within respective cylinder chambers, wherein the pistons are spaced from the walls of the cylinder chambers, engage only their respective seals and have no metal to metal contact with the cylinder chambers. As in Hill, the pistons are maintained in continuous engagement with their seals and the pumping chambers are provided with both inlet and outlet valves. However, in Huber, as in Hill, the seal between each piston and its pumping chamber also separates the pumping chamber from the actuator chamber, and the fluid flow path is restricted and tortuous. If an attempt were made to pump a fluent material with the Huber design, it would suffer the same shortcomings and would be just as unsuitable for industrial use as the pump of Hill.

SUMMARY OF THE INVENTION

The object of the present invention is to provide an improved pump assembly of the type described which overcomes the problems, deficiencies and shortcomings of the prior art; which produces a pump having greatly improved operational characteristics and a prolonged service life; and which affords a highly versatile pump assembly adapted for a myriad of industrial uses.

The invention is derived from and specifically improves upon the "Funny" pump heretofore made and sold by Binks Manufacturing Company. The improved pump incorporates many of the proven elements of the "Funny" pump, including the same air motor and piston seal. The invention resides in a new combination of structural features which together produce substantially enhanced operational and performance advantages and improvements over the disclosures of the above referenced patents and the prior art "Glutton" and "Funny" pumps.

According to the present invention, each piston is longer than in the Funny pump and is maintained in continuous engagement with its seal; and the chamber within which the piston operates is provided with in-line inlet and outlet check valves so that there is just a single pumping chamber for each pump, not separate intake and output chambers. Each pumping chamber is of substantially uniform diameter from the piston seal to the end wall of the chamber, and the inlet and outlet check valves are axially aligned with one another parallel to and immediately adjacent the end wall of the pumping chamber, so that fluid flow through the chamber is essentially a straight line of flow diametrically across the chamber without angular transitions. To maintain an essentially straight line path of flow, the reciprocatory stroke of the pump piston is maintained quite short. A short stroke of the piston remains feasible in the present design because the piston is not withdrawn from its seal, and the suction force of the piston is transmitted directly to the associated inlet check valve. Despite the short stroke, the combination produces a significant increase in pumping capacity, with less down time and service requirements.

Compared to the Funny pump, an increase of only 1/16 inch in the length of the stroke, with other dimensions remaining constant, increased the output volume by about 50% with only a modest (e.g. 3%) increase in air consumption. The flow path of fluent material through the pumping chamber is short and straight, thereby facilitating the pumping of extremely viscous or stiff materials, and materials that are heat and/or shear sensitive.

Because there is no intake chamber, as in Drath et al. '109 and Schlosser '442, and the inlet to the pump is coupled directly to the inlet valve and pumping chamber, there is no limitation upon delivery of the fluent material to the pump under pressure for force feeding or supercharging the pumping chamber. Also, the prior art requirements for a bellows seal and a surge chamber are obviated.

The fluent material at the pump inlet can be pressurized, or two or more pumps can be used in series, to facilitate pumping of extremely viscous materials at high pressures and/or high volume flow rates. Elimination of the prior art intake chamber also contributes to elimination of the tortuous or serpentine fluid flow path of the prior art pumps and facilitates the inline or straight line fluid flow path of the pump of the invention, which further contributes to the ability of the pump to handle extremely viscous and shear sensitive materials. Consequently, the pump of the invention can handle fluent materials that could not be handled with the prior pumps, and can be used in systems applications in which the prior pumps could not be used, e.g., bulk storage systems with overhead storage tanks that impose a head pressure on the pump inlet.

Moreover, due to elimination of the intake chamber, the area rearwardly of or behind the piston, formerly required for the chamber, may now be vented to atmosphere to avoid the fluent material impediment to, and the consequent wasteful consumption of power on, the return or suction stroke of the piston. This results in a significant decrease in the power required for a given amount of work, or conversely, a significant increase in pumping capacity for a given energy input. Also, venting of the space accommodates ready detection of leakage past the piston seal. By providing a vent rearwardly of the piston, fluid leaking past the piston seal will be readily observable and the amount of leakage will indicate to the operator an appropriate time to replace the seal. Also, by returning any leaking material to the source, seal replacement becomes less urgent, unless the pump is being used for metering. These advantages could not be attained with the prior pump.

In addition, should the seal between the air motor and the piston rod of either pump unit fail, air leaking from the motor through the seal will not enter into the path of flow of the fluent material and will not render the pump inoperable; the air will simply be vented to the atmosphere harmlessly. This feature of the pump of the invention also facilitates operation of the pump by means of a hydraulic motor, should that be desired, since hydraulic fluid leaking from the actuator will not contaminate the fluent material; it can simply be drained away harmlessly.

The invention also provides the advantage that pump units for use in the assembly can be produced in a modular design that will accommodate facile and convenient manufacture of pump assemblies that will provide two different pumping pressures or two different volumes or rates of material flow (e.g., for metering respective components of a two component material system), or that will pump a single material or two different materials; or that will supply a single material consuming device or two such devices (e.g., spray guns). Thus, the assembly can be made extremely versatile.

Also, the construction and modular design of the pumping units facilitates rapid disassembly and reassembly of each unit for inspection, repair and replacement of parts (e.g., the piston seal) as and when needed, with exceedingly little down time or loss of production.

The invention thus provides significant advantages over the prior art. Advantages and achievements in addition to those described will become apparent from the following detailed description, as considered in conjunction with the accompanying drawings.

DETAILED DESCRIPTION

The following is a description of the best mode presently contemplated by the inventors for carrying out their invention. Other modes of carrying out the invention, without departing from the scope of the invention, will become apparent to those skilled in the art as the description proceeds.

Figure 1:
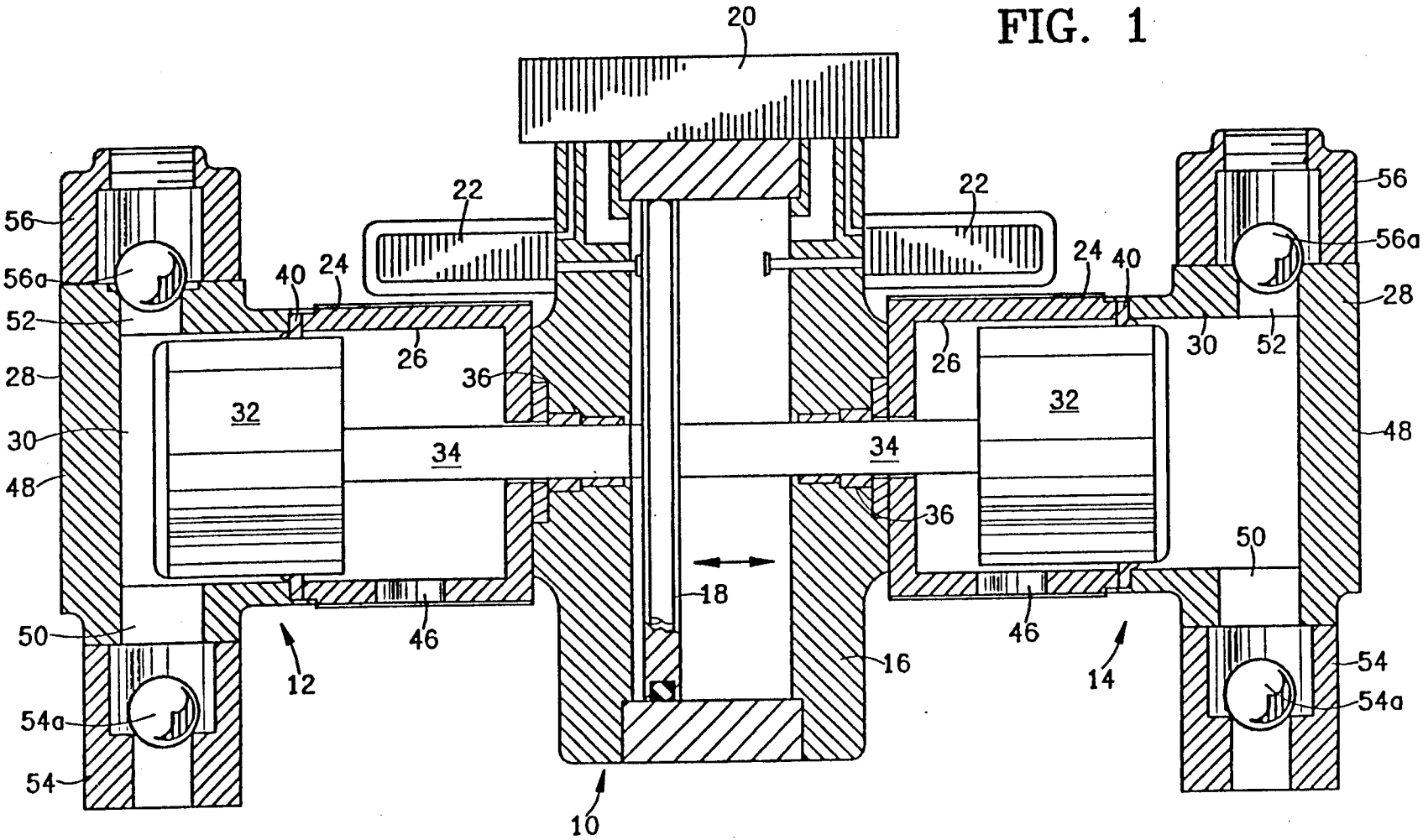
FIG. 1 is a vertical longitudinal section schematically illustrating the preferred embodiment of the pump assembly of the present invention.
Figure 4:
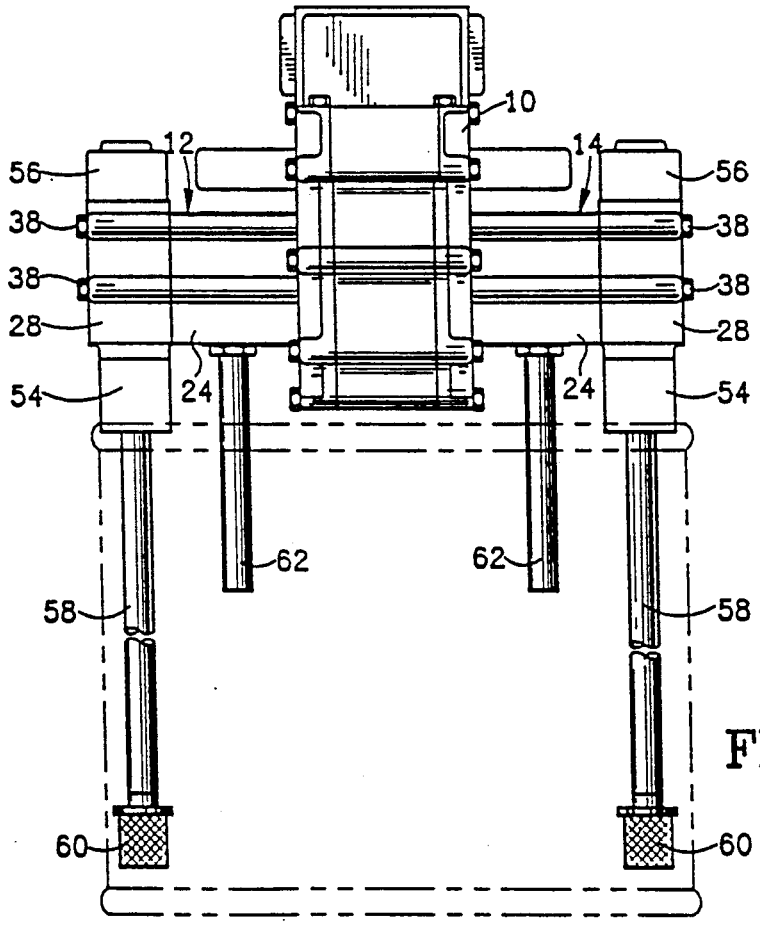
FIG. 4 is a front elevation of the pump assembly of FIG. 1 showing the same associated with a material supply vessel and equipped with return conduits for recirculation of fluent materials that may by-pass the piston seals.

Referring to FIGS. 1 and 4 of the drawings, the pump assembly of the invention is usually oriented with its axis of reciprocation horizontal and is comprised of a central actuator 10 and a pair of piston pump units 12 and 14 at opposite sides of the actuator.

The actuator 10 is preferably a fluid actuated dual acting reciprocating piston motor, but it could also be a mechanical or electrically driven reciprocating actuator. For most industrial applications, because of the customary availability of compressed air, the actuator will usually be air operated. However, due to the unique construction of the pump of the invention, it is also feasible to use a hydraulic actuated reciprocating motor, as will presently appear.

In the preferred embodiment, as shown in FIG. 1, the actuator is an air operated motor of a type well-known in the art (see for example the Drath et al. and Schlosser patents). The motor is comprised, in essence, of a cylinder 16 having a larger diameter than the pump pistons, a piston 18 reciprocal in and having a sealed relationship with the peripheral wall of the cylinder, an air control valve 20 for supplying compressed air alternately to the opposite sides of the piston 18, and a pair of pilot valves 22 which are actuated by the piston adjacent the opposite ends of its stroke of movement to cause the air control valve to supply air to one side of the piston (the left side as viewed in FIG. 1) while venting the cylinder at the opposite side of the piston to cause the piston 18 to reciprocate back and forth. At such times as the piston area times the fluid pressure in the pumps equals the piston area times the air pressure in the motor, the piston 18 will halt its movement until fluid is withdrawn from the pumps, whereupon the motor piston will resume its reciprocatory movement.

The pumps 12 and 14 as shown in FIG. 1 are of the same construction, but may be of different sizes or utilize different materials of construction as will presently appear. Each pump is comprised of a static chamber block 24 defining a static chamber 26, an output block 28 defining a pumping chamber 30, a piston 32 reciprocable within the static and pumping chambers, and a piston rod 34 extending through the static chamber from the pump piston 32 to the motor piston 18 for coupling the pump piston to the motor piston for reciprocation thereby. Each end wall of the motor cylinder 16 is provided with a bearing and seal assembly 36 for supporting and guiding the respective piston rod 34 and for establishing a seal between the rod and the motor to prevent or at least mitigate wasteful leakage of air from the motor. The seals are a conventional type because the present invention eliminates the need for the bellows type seals employed in the prior pump.

As illustrated in FIG. 1, reciprocation of the air motor piston 18 causes the pumps 12 and 14 to be operated alternately, i.e., the piston 18 drives the piston of one pump on a forward pressure producing stroke and drives the piston of the other pump on a rearward suction producing stroke, and then reverses to drive the one pump piston on a suction stroke and the other pump piston on a pressure stroke. In accordance with the invention, the reciprocatory stroke of the pistons is short, i.e., in the order of about 1½ to 2 inches for purposes to be described.

Figure 2:
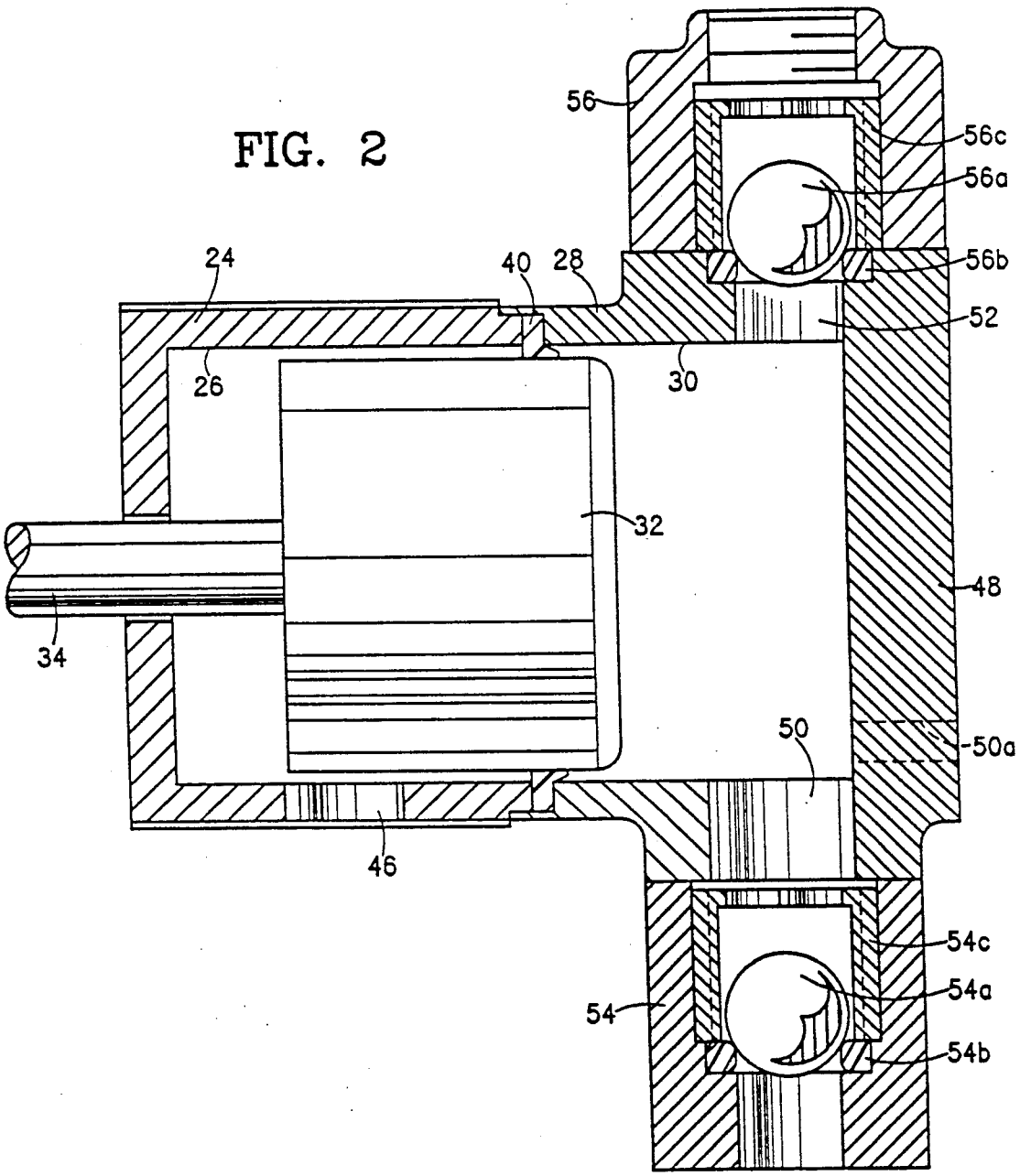
FIG. 2 is a vertical longitudinal sectional view of one of the single acting pumps incorporated in the pump assembly of FIG. 1.

As shown on an enlarged scale in FIG. 2, the static chamber 26 and pumping chamber 30 are cylindrical, preferably of the same diameter, and aligned axially with one another. The two blocks 24 and 28 may be of rectangular or similar cross-section so that assembly and mounting bolts 38 (FIG. 4) can be extended longitudinally through the four corner portions of the blocks to secure the two blocks to one another and the adjacent end wall of the motor cylinder. Preferably, at their mating ends, the static block 24 has an undercut and the output block 28 has an axially extending annular lip of a diameter to mate with the undercut to assure axial alignment of the two blocks. Clamped between the abutting faces of the two blocks, by means of the bolts 38, is a multipurpose seal 40, one purpose of which is to establish a seal between the two blocks.

The piston 32 is of a smaller diameter than and has its periphery spaced inwardly from, i.e., in inwardly spaced gap relation to, the peripheral walls of the chambers 26 and 30 so that there is no metal to metal contact between the piston and the walls of the chambers and fluent material to be pumped may enter into the annular space between the piston periphery and the peripheral wall of the pumping chamber 30. As shown in FIG. 1, the piston 32 is retained in axial alignment with the chambers 26 and 30 by the piston rod bearing means 36.

Figure 3:
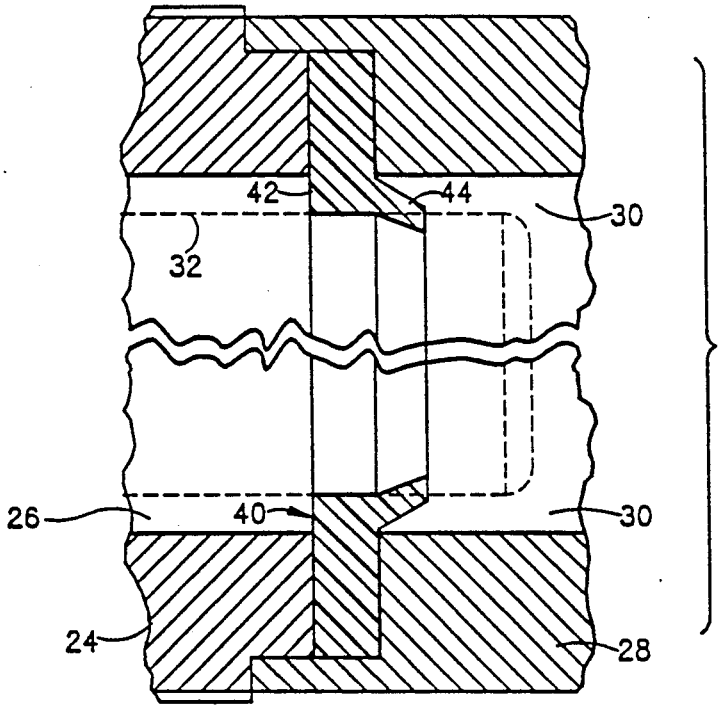
FIG. 3 is a fragmentary vertical sectional view, on an enlarged scale, of the piston seal of the pump of FIG. 2 illustrating in dotted lines the interference fit of the piston in the seal.

In addition, in the preferred embodiment, the seal 40 assists in maintaining the axial alignment of the piston in the pumping chamber. Though this seal has been in public use for some time, it is illustrated in detail in FIG. 3 as comprising a significant component in the preferred embodiment of the invention. As shown, the seal comprises a relatively rigid annular body portion 42 which is sealingly clamped at its outer marginal portions between the static block 24 and the output block 28, and which extends radially inwardly to and engages the periphery of the piston 32. Preferably the inner diameter of the body portion 42 of the seal is the same as the outer diameter of the piston so that there is a very tight, piston guiding fit between them. Extending forwardly into the pumping chamber from the inner marginal portion of the body 42 is an annular sealing and wiping lip 44 which has an interference fit with the piston, as revealed by the dotted line representation of the piston 32 in FIG. 3.

On the pressure stroke of the piston, fluent material being pumped enters into the space between the peripheral wall of the pumping chamber and the lip 44 of the seal and forces the lip into very intimately and pressure sealed relationship with the piston to prevent leakage of fluent material past the piston and to maintain pressure on the material being pumped. On the suction stroke of the piston, the lip 44, due to its shape and interference fit with the piston, will wipe the piston clean as the piston moves rearwardly through the seal. Thus the lip 44 performs a piston sealing and wiping function while the body 42 performs a piston guiding function and a sealing function between the blocks 24 and 28. To facilitate the attainment of these functions over a long service life, the seal 40 is preferably formed of ultra high molecular weight polyethylene ("UHMWPE").

In contrast to prior pumps of this general type, the piston 32 is not withdrawn from the seal 40 during reciprocation of the piston. In particular, the piston has a length in relation to its reciprocal path of movement such that the piston remains in continuous engagement with the seal 40. For example, with a reciprocatory stroke in the order of 1½ to 2 inches, the piston may have a length in the order of 2½ to 3 inches.

Because the piston remain engaged with the seal, the static chamber 26 does not form part of the path of fluid flow of the fluent material being pumped (as in the prior art), but instead serves to isolate the pumping chamber 30 from the motor or actuator means 10. Consequently, any air or other actuating fluid leaking from the motor past the seal assembly 36 will not enter into a material containing chamber or contaminate the material or render the pump inoperative. Rather the fluid will enter the static chamber and will be vented therefrom to atmosphere, suitably via a vent hole 46 (FIG. 2) in the peripheral wall of the block 24. Consequently, in practice of the present invention, hydraulic motors may be utilized as actuators, as well as air motors. In like manner, as the piston seal 40 becomes worn and fluent material being pumped commences leaking past the seal, the fluent material will simply drain into the static chamber 26 and out through the vent hole 46, whereupon the operator will be warned that the piston seal is leaking, and will be given an indication of the severity of the leak, so that he can ascertain the most appropriate time to shut the pump down for seal replacement and such other service as may prove advisable.

Seal replacement and other servicing is effected quickly and easily simply by removing the bolts 38, removing the output block from the static block, removing and replacing the seal, and reassemblying the two blocks and bolting the same together.

The pumping chamber 30 defined by the output block 28 is a blind end chamber having a peripheral wall and an end wall 48. In accordance with the invention, inlet and outlet ports 50 and 52 are formed in the peripheral wall of the output block adjacent, and preferably contiguous to, the end wall 48. To facilitate the flow of fluent material, the inlet port 50 is of a larger diameter than the outlet port 52, but the ports are otherwise aligned with one another, substantially coaxially, diametrically across the pumping chamber 30. The inlet 50 is provided with an inlet check valve 54 and the outlet is provided with an outlet check valve 56. Each valve is preferably comprised of a ball **54*a*–56*a* forming the movable valve element, a wear resistant seat 54*b*–56*b* for the ball and a ball retainer or guide 54*c*–56*c* which guides the ball relative to its seal and prevents the ball from seating on the inlet side of the inlet port 50 or the outlet side of the outlet valve housing 56. The guides 54*c*–56*c* each have cut away portions in their sidewalls, as indicated by dotted lines in FIG. 2, to facilitate passage of the fluent material past the balls. In the illustrated embodiment the inlet 50 and outlet 52** are aligned vertically with one another and the balls are seated and unseated by the negative and positive pressures generated by the piston. Other check valves may, of course, be utilized.

As the piston 32 is moved rearwardly on its suction stroke by the motor 10, the outlet check **56*a* will be seated on its seat 56*b* and the inlet check 54*a* will be lifted from its seat 54*b* and fluent material will be sucked from a source of supply through the check valve 54 and the pump inlet 50 into the pumping chamber 30. Then, as the piston reverses its direction and is moved forwardly, the inlet check 54*a* will be seated on its seat 54*b* and the outlet check 56*a* will be forced upwardly off its seat 56*b* by the fluent material being pushed forward under pressure by the piston 32, and the fluent material will be delivered under pressure via the outlet 52 and the check valve 56** to a point of use, for example, a spray gun or the like.

As the piston continues to reciprocate, fluent material will be pulled into and discharged from the pumping chamber and will pass essentially diametrically through the pumping chamber in a substantially straight line path of fluid flow. Because the stroke of the piston is short and the pumping chamber is large, there will be very little deviation of the fluent material from a straight line path of fluid flow. This is very beneficial when pumping any viscous material, but is especially important when pumping extremely abrasive materials, materials that are shear sensitive, and materials that are heat sensitive and can solidify due to heat generated by friction.

The position and stroke of the piston are designed to complement and assist in maintaining the straight line path of fluid flow of the fluent material. As shown at the left of FIG. 1, the piston on its pressure stroke approaches closely to the chamber end wall 48 and partially overlaps the pump inlet 50 and outlet 52, and on its suction stroke, as shown at the right in FIG. 1, is not retracted far from the path of alignment of the inlet and outlet. Consequently by virtue of its position and short stroke, the piston does not introduce any large or significant deviation in the path of flow of the fluent material diametrically across the pumping chamber from the inlet to the outlet.

By providing different sizes of motors 10 and/or different sizes of pump units 12–14, a variety of different pump output pressures and rates of flow can be provided. For example, the prior art Binks Funny pump has been made and sold for operation at six different output pressure ratios, i.e., 3:1, 4½:1, 8:1, 12:1, 15:1 and 23:1. This has been accomplished by combining one or another of two air motors with any of three different sizes of pump units. The two air motors have respective piston diameters of approximately 5.92 inches and 7.25 inches, and the three pumps have respective piston diameters of approximately 3.418 inches, 2.1 inches and 1.52 inches. With the air motors operating at 100 psi air pressure, the larger pump provides output pressures of 300 psi and 450 psi, the medium size pump provides output pressures of 800 psi and 1,200 psi, and the small pump provides output pressures of 1,500 psi and 2,300 psi. The same pump and motor sizes may be utilized in practice of the present invention to provide the same variety of output pressure ratios.

One remarkable difference is that the pump of the present invention can do more work with the same energy, or the same work with less energy, than the prior art pump. Specifically, the pump of the invention, utilizing the same air motor, the same pump piston sizes and nearly the same energy input (i.e. air pressure and air consumption) provides a volume flow rate much greater than that of the prior pump. With only a 1/16 inch increase in the stroke of the piston, the flow rate is increased by about 50% with only about a 3% increase in air consumption. Also, since the piston remain in contact with its seal, and is not withdrawn from and forced back through the seal, both the piston and the seal should have a prolonged service life.

In a preferred example of the larger size pump as constructed in accordance with the present invention, the static and pumping chambers have an inner diameter of 3.630 inches, the diameter of the piston is 3.418 inches, the seal has an inner diameter of 3.418 inches at the body 42 and an inner diameter of 3.315 inches at the lip 44, and the piston is 2.75 inches long and has a stroke of 1.812 inches.

The pump also lends itself to fabrication of pump units of modular design so that one of the pump units 12–14 can be made of one size and the other of another size, thereby to provide different output pressures and/or flow rates and to accommodate the pumping of different fluent materials. This also facilitates use of the pump assembly for metering two or more components of a plural component fluent composition. Moreover, by providing a second check-valved inlet into the pumping chamber 30, e.g., as indicated by dotted lines at 50*a* in FIG. 2, a second fluid may be introduced into the chamber simultaneously with a first fluent material on the suction stroke of the piston and the piston will then discharge a mixture of the two on its pressure stroke. The second inlet 50*a* may be located substantially anywhere in the end wall or the peripheral wall of the chamber 30 in the position deemed most advantageous for the introduction of the second fluid into the fluent material entering at inlet 50.

When pumping a single fluent material, the inlets to the two pump units 12–14 may be interconnected by a manifold having a single inlet conduit from a source of supply. Alternatively, each pump unit may have its own supply conduit as shown by the conduits 58 in FIG. 4. Preferably each intake conduit is provided with a strainer 60 for avoiding delivery to the point of use of a lump or chunk of the material being pumped.

The outlets of the two pumps may likewise be interconnected by a manifold for delivery to a single point of use, or the two outlets may have outlet conduits leading to respective points of use. As further shown in FIG. 4, the vent 46 in each static chamber block 24 may be provided with a drain conduit 62 for returning any fluent material leaking past the piston seal to the fluent material container for recirculation back to the pump inlet.

With this return to source, seal replacement becomes less urgent. Also, with a conduit return to source, an additional vent to atmospheric air would be provided in the wall of the static block to prevent any extraneous resistance to the piston suction stroke and also to vent any actuating fluid leaking from the motor 10.

In addition to sucking fluent material directly from a source of supply, as illustrated schematically in FIG. 4, the inlets to the pumps 12 and 14 could be force fed from a pressurized source, an overhead tank providing a pressure head, or another pump. There is no impediment to supercharging the material at the inlet to the pump of the invention. Consequently, the pump is capable of handling materials that could not be handled with the prior art pumps of this type, such as extremely viscous materials. Also the pump has the capacity for use in systems applications for which the prior pumps are not suited specifically those in which the material is pressurized before reaching the pump inlet, e.g., overhead bulk storage systems wherein the fluent material is under a pressure head.

The objects and advantages of the invention have thus been shown to be attained in an economical, practical and facile manner.

While a preferred embodiment of the invention has been herein illustrated and described, it is to be appreciated that various changes, rearrangements and modifications may be made therein, without departing from the scope of the invention as defined by the appended claims.

What is claimed is:

1. A pump assembly especially adapted for pumping viscous and abrasive fluent materials comprising a reciprocal actuator having a short reciprocatory stroke, a pump unit at one side of said actuator, said pump unit comprising means defining a static chamber adjacent said actuator, said static chamber having a peripheral wall with a vent port therethrough, said static chamber being open at the end thereof remote from said actuator, an outlet block adjacent said static chamber defining a pumping chamber coaxial with said static chamber, said pumping chamber having a peripheral wall and an end wall remote from said static chamber, said pumping chamber being open at the end thereof adjacent said open end of said static chamber, said pumping chamber peripheral wall being aligned with said static chamber peripheral wall, means for securing the open end of said output block to the open end of said static chamber means and for securing said static chamber means to said actuator, a piston reciprocable axially within said static and pumping chambers and movable forwardly toward and rearwardly away from said end wall of said pumping chamber, said piston being of smaller diameter than and having its periphery in inwardly spaced gap relation to the peripheral walls of said chambers, an annular seal clamped by said securing means between the peripheral walls of said output block and said static chamber means at their open ends and sealing said walls one to the other, said seal extending radially inwardly into engagement with the periphery of said piston and including a flexible annular lip engaging the periphery of said piston and extending toward said pumping chamber for wiping and sealing engagement with the periphery of said piston, a piston rod extending from said piston through said static chamber to said actuator and coupling said piston with said actuator for imparting short reciprocal strokes of movement to said piston, said piston being of a length in relation to its reciprocal path of movement that the periphery of said piston remains continuously in engagement with said seal and engages only said seal, an inlet extending through the peripheral wall of said pumping chamber contiguous to the end wall of said pumping chamber, means for introducing into said inlet fluent material to be pumped, an inlet check valve in said inlet between said pumping chamber and said fluent material introducing means, an outlet extending through the peripheral wall of said pumping chamber contiguous to the end wall of said pumping chamber, and an outlet check valve in said outlet, said actuator reciprocating said piston through a rearward suction stroke for drawing fluent material into said pumping chamber through said check valved inlet and a forward pressure stroke for forcing fluent material from said pumping chamber through said check valved outlet, said inlet and outlet being aligned with one another and in conjunction with said piston providing a short and essentially straight line path for fluid flow of fluent material substantially diametrically through said pumping chamber contiguous to the end wall of said pumping chamber, said actuator reciprocating said piston through short reciprocal strokes from a forward position closely adjacent the end wall of said pumping chamber to a rearward position spaced a short distance from said end wall for establishing and maintaining substantially straight line flow of fluent material diametrically through said chamber contiguous to said end wall from said inlet to said outlet, said static chamber spacing said pumping chamber from said actuator, said vent through the peripheral wall of said static chamber comprising a drain, said static chamber being vented through said drain and physically isolating said pumping chamber from said actuator.

2. A pump as set forth in claim 1, said fluent material introducing means supplying fluent material to said inlet under positive pressure.

3. A pump as set forth in claim 1, including a second inlet to said pumping chamber, means for introducing a second fluid to said second inlet, and a second inlet check valve in said second inlet between said pumping chamber and said second fluid introducing means, said piston on its suction stroke drawing fluent material and the second fluid through said check valved inlets into said pumping chamber and on its pressure stroke forcing a mixture of the fluent material and the second fluid through said check valved outlet.

4. A pump assembly as set forth in claim 1, said static chamber receiving from said pumping chamber any fluent material that may leak past said seal and including means for returning said fluent material for recirculation to said fluent material introducing means.

5. A pump assembly as set forth in claim 1, said static chamber receiving from said pumping chamber and draining through said vent therein any fluent material that may leak past said seal, said actuator comprising a fluid actuated dual acting reciprocatory motor and including means for sealing said piston rod relative to said motor, said static chamber receiving from said motor and venting through said vent therein any actuating fluid that may leak past said piston rod sealing means.

6. A pump assembly as set forth in claim 1, including a second one of said pump units on the other side of said actuator and actuated by said actuator alternately with the first named pump unit, the static chamber means, output blocks and pistons of the two pump units being of modular construction and interchangeably mountable on the actuator to faciliate variations in the pumping characteristics of the two units in one or more of pressure, volume and fluent material pumped.

7. A pump assembly as set forth in claim 1, wherein said short reciprocal strokes of said piston is a stroke of between $1\frac{1}{2}$ and 2 inches, and said piston has a diameter of between $1\frac{1}{2}$ and $3\frac{1}{2}$ inches.

8. A pump assembly as set forth in claim 1, wherein said short reciprocal strokes of said piston is a stroke of a distance no greater than the diameter of said piston.

9. A pump assembly for pumping fluent materials comprising an outlet block defining a pumping chamber, said pumping chamber having a cylindrical peripheral wall and an end wall;

a static block defining a static chamber, said static block abutting said outlet block, said static chamber having a cylindrical peripheral wall coaxial with and of substantially the same diameter as said pumping chamber peripheral wall, said static chamber having a vent to the atmosphere;

a piston reciprocal within said pumping chamber and said static chamber, said piston being of smaller diameter than and having its periphery in inwardly spaced gap relation to the peripheral walls of said pumping chamber and said static chamber;

an annular seal clamped between said outlet block and said static block, said seal extending radially inwardly into engagement with the periphery of said piston, said seal sealing said outlet block to said static block and said outlet block to said piston, the periphery of said piston being in continuous engagement with said seal and only said seal and remaining spaced from all other surfaces within the pump;

an inlet to said output block, said inlet having a check valve;

an outlet from said output block, said outlet having a check valve; and means for reciprocating said piston within said pumping chamber and said static chamber.

10. A pump assembly as in claim 9, wherein said reciprocating means reciprocates said piston through strokes having a distance shorter than the diameter of said piston.

11. A pump assembly especially adapted for pumping viscous and abrasive fluent materials comprising a fluid actuated dual acting reciprocatory motor having a horizontal axis of reciprocation and a short reciprocatory stroke, a pump unit on each of the opposite sides of said motor, each said pump unit comprising a static block next to said motor defining a cylindrical static chamber coaxial with said motor, said static chamber having a peripheral wall with a downwardly open vent port therethrough and being axially open at the end thereof remote from said motor, an outlet block next to said static block defining a cylindrical pumping chamber coaxial with said motor and said static chamber, said pumping chamber being axially open at the end thereof next to said static chamber, having a peripheral wall of substantially the same diameter as said static chamber peripheral wall and including a blind end wall at the end thereof remote from said static chamber, means for securing the axially open end of said output block to the axially open end of said static block and for securing said static block to said motor, a cylindrical piston reciprocable coaxially within said static and pumping chambers and movable forwardly toward and rearwardly away from said end wall of said pumping chamber, said piston being of smaller diameter than and having its periphery in inwardly spaced gap relation to the peripheral walls of said chambers, an annular seal clamped by said securing means between the peripheral walls of said output block and said static block at said open ends thereof and sealing said blocks one to the other, said seal extending radially inwardly into engagement with the periphery of said piston and including a flexible annular lip engaging the periphery of said piston and extending toward said pumping chamber for wiping and sealing engagement with the periphery of said piston, a piston rod extending axially from said piston through said static chamber to said motor and coupling said piston with said motor for imparting short reciprocal strokes of movement to said piston, said piston being of a length in relation to its reciprocal path of movement that the periphery of said piston remains continuously in engagement with said seal and engages only said seal, an inlet extending downward through the peripheral wall of said pumping chamber contiguous to the end wall of said pumping chamber, means for introducing into said inlet fluent material to be pumped, an inlet check valve in said inlet between said pumping chamber and said fluent material introducing means, an outlet extending substantially vertically upward through the upper portion of the peripheral wall of said pumping chamber contiguous to the end wall of said pumping chamber in essentially diametrical alignment with said inlet, and an outlet check valve in said outlet, said motor reciprocating said piston through a rearward suction stroke for drawing fluent material into said pumping chamber through said check valved inlet and a forward pressure stroke for forcing fluent material from said pumping chamber through said check valved outlet, said inlet and outlet being aligned with one another and in conjunction with said piston providing a short and essentially straight line path for fluid flow of fluent material substantially diametrically through said pumping chamber contiguous to the end wall of said pumping chamber, said motor alternately reciprocating each of said pistons through short reciprocal strokes from a forward position closely adjacent the end wall of the respective pumping chamber to a rearward position spaced a short distance from said end wall for establishing and maintaining substantially straight line flow of fluent material diametrically through the respective pumping chamber contiguous to said end wall from said inlet to said outlet, each said static chamber spacing the respective pumping chamber from said motor and isolating the respective pumping chamber and said motor from one another, each said static chamber receiving and venting through said vent therein any fluent material leaking from the respective pumping chamber and any actuating fluid leaking from said motor.

* * * * *